US007404487B2

(12) United States Patent
Kumakura et al.

(10) Patent No.: US 7,404,487 B2
(45) Date of Patent: Jul. 29, 2008

(54) COMMODITY PACKAGE

(75) Inventors: Katsuhiko Kumakura, Kyoto (JP); Yoshikazu Yukami, Yao (JP); Masaru Kanda, Nara (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 361 days.

(21) Appl. No.: 10/532,606

(22) PCT Filed: Dec. 22, 2003

(86) PCT No.: PCT/JP03/16504

§ 371 (c)(1),
(2), (4) Date: Apr. 25, 2005

(87) PCT Pub. No.: WO2004/060770

PCT Pub. Date: Jul. 22, 2004

(65) Prior Publication Data

US 2006/0000738 A1 Jan. 5, 2006

(30) Foreign Application Priority Data

Dec. 27, 2002 (JP) ..... 2002-381253

(51) Int. Cl.
*B65D 85/00* (2006.01)
*B65D 73/00* (2006.01)

(52) U.S. Cl. ..... 206/469; 206/467; 206/703

(58) Field of Classification Search ..... 206/703–705, 206/461–471, 495
See application file for complete search history.

(56) References Cited

U.S. PATENT DOCUMENTS

| | | | | | |
|---|---|---|---|---|---|
| 3,556,292 | A | * | 1/1971 | Krzyzanowski | 206/464 |
| 4,319,684 | A | * | 3/1982 | Backman et al. | 206/464 |
| 4,499,353 | A | * | 2/1985 | Shields | 206/470 |
| 4,512,474 | A | * | 4/1985 | Harding | 206/461 |
| 4,739,883 | A | * | 4/1988 | Mohs et al. | 206/470 |
| 4,899,877 | A | * | 2/1990 | Kiernan | 206/470 |
| 5,143,215 | A | * | 9/1992 | Hartley et al. | 206/461 |
| 5,358,113 | A | * | 10/1994 | Hellenbrand | 206/470 |
| 5,579,910 | A | * | 12/1996 | Bennett | 206/469 |
| 6,244,444 | B1 | | 6/2001 | Jacobus et al. | |
| 6,276,529 | B1 | * | 8/2001 | Feehan, Jr. | 206/469 |
| D489,253 | S | * | 5/2004 | Kumakura et al. | D9/415 |

(Continued)

FOREIGN PATENT DOCUMENTS

JP 63-152563 6/1988

(Continued)

*Primary Examiner*—J. Gregory Pickett
(74) *Attorney, Agent, or Firm*—McDermott Will & Emery LLP

(57) ABSTRACT

The present invention relates to a commodity package, comprising a hanging member that has a hole for hanging, and a holding body for holding an article. The holding body has a first cutting portion for separating a first recess and the upper part of a first brim portion from each other, and a second cutting portion for separating a second recess and the upper part of a second brim portion from each other. The hanging member has a third cutting portion for separating the upper part and the lower part thereof from each other. The first, second and third cutting portions are provided at different heights. This makes it possible for the commodity package, when hung, to maintain favorable balance and obtain sufficient intensity.

9 Claims, 11 Drawing Sheets

U.S. PATENT DOCUMENTS

| | | | | | |
|---|---|---|---|---|---|
| D494,464 | S | * | 8/2004 | Kumakura et al. | D9/415 |
| D497,547 | S | * | 10/2004 | Kumakura et al. | D9/415 |

FOREIGN PATENT DOCUMENTS

| | | |
|---|---|---|
| JP | 3035557 | 3/1997 |
| JP | 11-198965 | 7/1999 |
| JP | 2000-7024 | 1/2000 |
| JP | 2000-118558 | 4/2000 |
| JP | 2000-281127 | 10/2000 |
| JP | 3085868 | 5/2002 |
| WO | WO 02/38470 | 5/2002 |

* cited by examiner

COMMODITY PACKAGE

TECHNICAL FIELD

The present invention relates to a commodity package for containing an article, such as batteries, to be exhibited for sales or some other purposes.

BACKGROUND ART

As commodity packages for housing batteries etc., blister packaging has been in wide use for the reason of a good exhibition effect at shops, low cost and the like. In the blister packaging, a recess is formed by thermal formation or the like in a transparent synthetic resin sheet, and articles are housed in the recess. The opening of the recess is closed by bonding the rim of the recess to a board, such as a pasteboard, so that articles are held in the recess.

There have also been proposed a commodity package usable as a container for storage even after the opening thereof, and a commodity package reusable and readily disposable (e.g. U.S. Pat. No. 6,244,444)

FIG. 12 shows a perspective view of a battery package as one of examples of conventional commodity packages. The conventional battery package consists of a battery-housing portion 51 for housing plural articles of battery 50, and a board 53 having a hole 53*a* for hanging. When the package is hung, a shoulder portion 54*a* of the under part 54 of the board, having been formed by providing a slit in the board 53, is hooked on a shoulder portion 52*a* having been formed on a lid portion 52 for closing the battery-housing portion 51.

However, there has been a problem with the intensity of the commodity package itself because it is only the shoulder portion 52*a* of the board 53 that supports the entire battery-housing portion 51. There has also been another problem that, because the articles of battery 50 are housed in one side of the board 53, it is difficult to hang the commodity package, housing a number of battery articles, in a balanced manner.

In order to solve the aforementioned conventional problems, accordingly, an object of the present invention is to provide a commodity package that is capable of maintaining favorable balance when hung, and also has sufficient intensity.

DISCLOSURE OF INVENTION

The present invention provides a commodity package comprising a hanging member that has a hole for hanging, and a holding body for holding an article, characterized in that the holding body has: a housing portion including a first recess and a second recess for housing the article; a first brim portion and a second brim portion for closing the first recess and the second recess to form the housing portion; and a bending portion that connects the first recess and the second recess, and bends to fold back the holding body so that the first recess and the second recess are faced to each other, the hanging member is interposed between the brim portions and the recesses, the holding body has a first cutting portion for separating the first recess and the upper part of the first brim portion from each other, and a second cutting portion for separating the second recess and the upper part of the second brim portion from each other, the hanging member has a third cutting portion for separating the upper part and the lower part thereof from each other, and the first, second and third cutting portions are provided at different heights.

It is preferable that the housing portion is formed on each side of the plane of the hanging member, the plane having the hole for hanging.

It is preferable that part of the first cutting portion and part of the second cutting portion are shaped such that the holding body forms a knob portion for opening and closing the commodity package after the cutting portions have been cut.

It is preferable that, in a portion where the hanging member is interposed between the first brim portion and the second brim portion, one of the brim portions has a projection for crushing and the other of the brim portions has a depression into which the projection is to fit, and the hanging member has a hole that accommodates the projection, such that the projection for crushing is put thorough the hole, the projection for crushing in the state of fitting into the depression is crushed, and a latch portion, formed as the projection for crushing transforms by extending outward, is latched into the hole and the depression to fix the hanging member to the holding body.

It is preferable that one of the first brim portion and the second brim portion has a depression and the other of the brim portions has a projection to fit into the depression.

It is preferable that the holding body has a folding-back portion on each of the side rims thereof.

It is preferable that each of the first recess and the second recess has a depression on the right or the left side face of the inside thereof, and the hanging member has projections to fit into the depressions.

It is preferable that the bending portion comprises: a bottom portion that connects the first recess and the second recess; and a pair of line portions for folding capable of bending to fold back the holding body so that the recesses are faced to each other, pair of line portions for folding being provided on boundary between the bottom portion and the recesses.

It is preferable that a holding body in which the housing portion is formed with the bottom portion can be placed vertically.

BEST MODE FOR CARRYING OUT THE INVENTION

In the following, a battery package containing plural battery articles is described as one example of embodiments of the commodity package in accordance with the present invention.

Embodiment 1

A battery package containing four cylindrical battery articles is explained below by reference to FIGS. 1 to 3.

Figure 1:
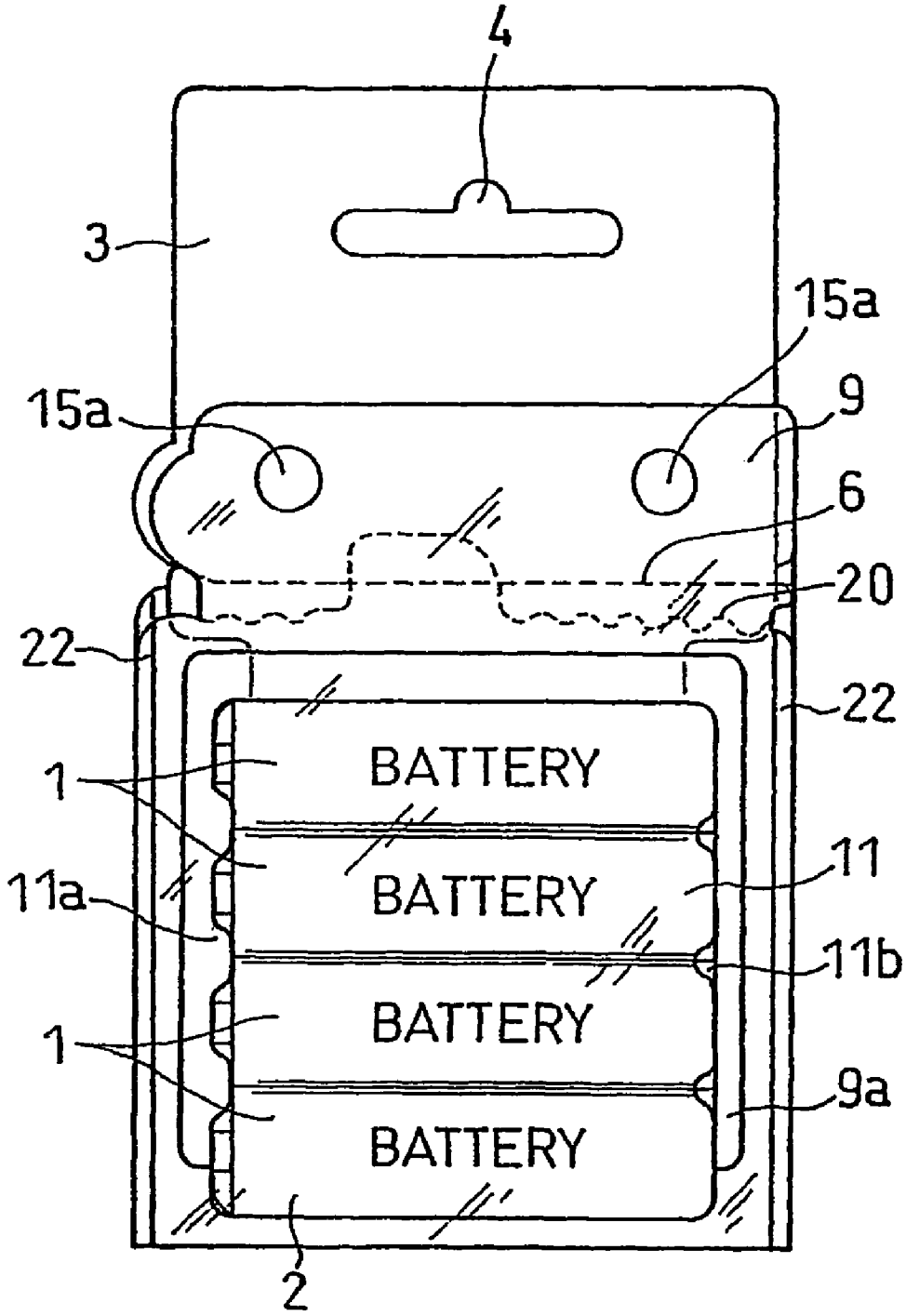
FIG. 1 is a front view of a battery package in Embodiment 1.
Figure 2:
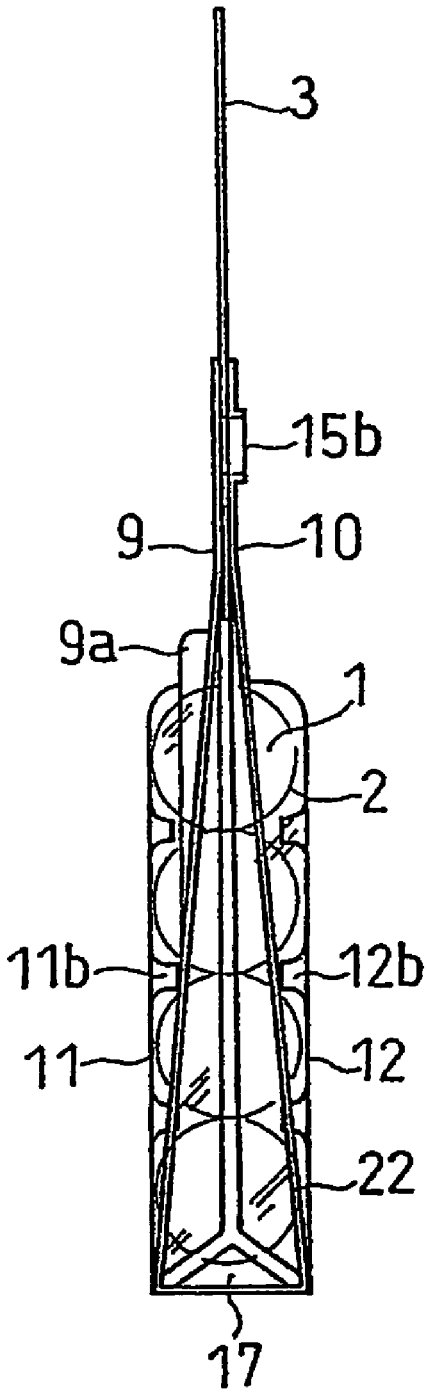
FIG. 2 is a side view of the same battery package.
Figure 3:
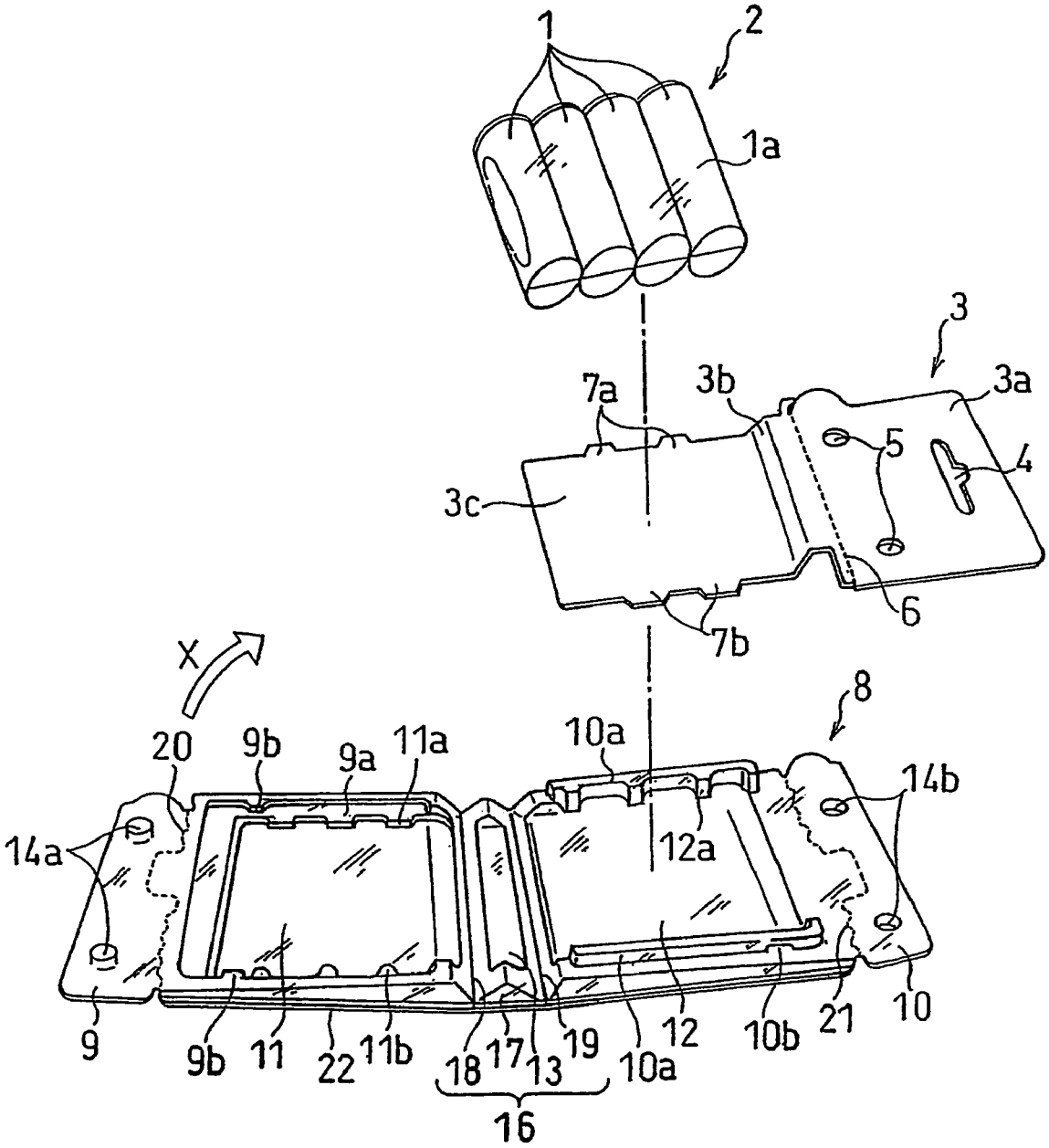
FIG. 3 is an exploded perspective view of the same batter package.

FIG. 1 is a front view of a battery package of the present invention that houses a unit pack 2 comprising a wrapping portion 1*a*, which is obtained by vertically laying down and shrink-packing four articles of cylindrical battery 1 (cf. FIG. 3); FIG. 2 is a side view of the same battery package; and FIG. 3 is an exploded perspective view of the same battery.

The battery package of the present invention is constituted of a hanging member 3 having a hole 4 for hanging, and a holding body 8 for holding a unit pack 2. The holding body 8 has a first recess 11 and a second recess 12, which house the unit pack 2, and the recesses 11 and 12 are closed by bending the holding body 8 in the direction of the pointer X in FIG. 3 to form a housing portion. The holding body 8 has a first brim portion 9, a second brim portion 10, and a bending portion 16 that connects the recess 11 and the recess 12, and bends to fold back the holding body 8 so that the first recess 11 and the second recess 12 are faced to each other.

As shown in FIG. 2, the hanging member 3 is interposed between the first recess 11 and the second recess 12 such that, when the battery package is hung, the weight of the unit pack 2 is loaded on both sides of the hanging member 3 in a balanced manner. This allows the battery package to maintain favorable balance when hung.

The holding body 8 has a first cutting portion 20 comprising a breaking line for separating the first brim portion 9 and the first recess 11 from each other, and a second cutting portion 21 comprising a breaking line for separating the second brim portion 10 and the second recess 12 from each other. Further, the hanging member 3 has a third cutting portion 6 comprising a breaking line for separating the upper part 3*a* and the under part 3*c* from each other. As in FIG. 1 and FIG. 8 that shows the battery package after the opening thereof, the first cutting portion 20, the second cutting portion 21 and the third cutting portion 6 are provided at different heights when a battery package is constituted by folding back the holding body 8 to sandwich the hanging member 3. The provision of the respective cutting portions at different heights enables improvement in intensity of the battery package when hung for exhibition.

In the battery package of the present invention, the upper part 3*a* of the hanging member 3 is interposed between the first brim portion 9 and the second brim portion 10, and the lower part 3*c* of the hanging member 3 is interposed between the first recess 11 and the second recess 12. Further, the hanging member 3 has a step portion 3*b* for forming a step as deep as the recess 12 between the upper part 3*a* and the lower part 3*c*, and the lower part 3*c* is provided along with the inner face of the recess 12. Namely, the lower part 3*c* of the hanging member 3 is housed together with the unit pack 2 into the housing portion.

In a portion where the upper part 3*a* of the hanging member 3 is interposed between the first brim portion 9 and the second brim portion 10, the first brim portion 9 has a pair of projections 14*a* for crushing while the second brim portion 10 has a pair of depressions 14*b* into which the projections 14*a* are to fit. The upper part 3*a* of the hanging member 3 has a pair of holes 5 in such a shape and size as to correspond to the projection 14*a* for crushing.

Figure 4:
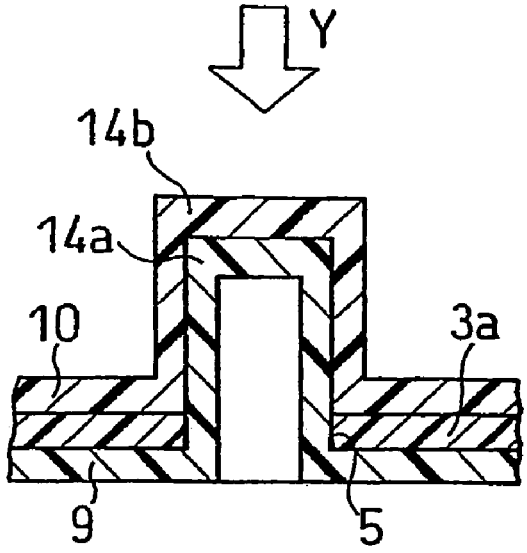
FIG. 4 is a schematic vertical sectional view illustrating the vicinity of a projection for crushing before a hanging member is fixed to a holding body.
Figure 5:
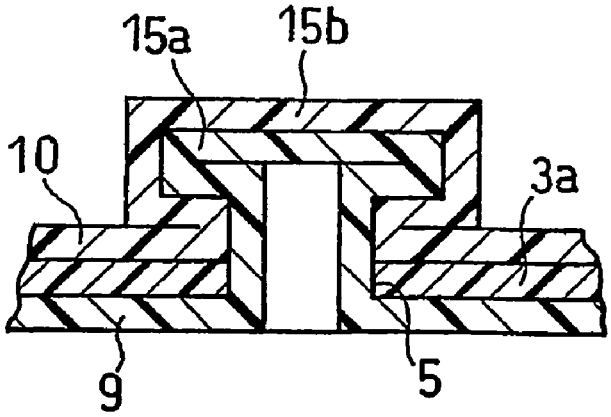
FIG. 5 is a schematic vertical sectional view illustrating the vicinity of a latch portion after a hanging member is fixed to a holding body.

In fixing of the hanging member 3 to the holding body 8, for example, the projection 14*a* for crushing is passed through the hole 5, and then fit into the depression 14*b* via the hanging member 3 (cf. FIG. 4). In this state, the projection 14*a* for crushing is crushed together with the depression 14*b* from above, as indicated by the pointer Y, and then the projection 14*a* for crushing is made transformed as extending outward, thereby forming a latch portion 15*a*, as shown in FIG. 5. The depression 14*b* transforms into a depression 15*b* covering the latch portion 15*a*. Here, the latch portion 15*a* is latched into the second brim portion 10 and the upper part 3*a* of the hanging member 3. The hanging member 3 is firmly fixed to the holding material 8 because of such formation of the latch portion 15*a*.

It is possible by the aforementioned method to keep appearance of a battery package favorable and the fixing status thereof firm, thereby preventing trouble and holding down cost. Another fixing method beyond the above described may be integration by means of thermal welding or the like.

Figure 8:
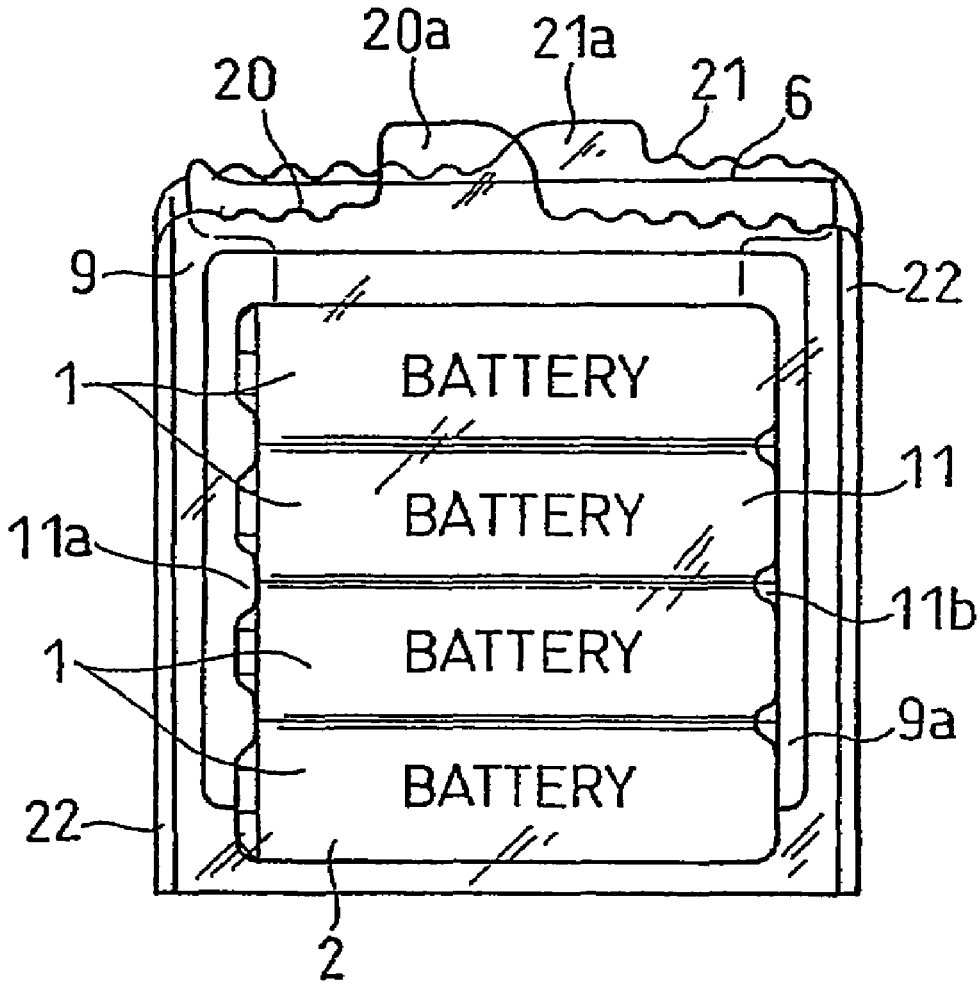
FIG. 8 is a front view of the battery package after the opening thereof in Embodiment 1.

For opening the battery package, a user of the battery package cuts it along the cutting portions 6, 20 and 21 while holding, with his both hands, the upper part 3*a* of the hanging member 3 and the holding body 8. A pair of knob portions 20*a* and 21*a* for opening and closing the battery package, formed by the cutting portions 20 and 21 to facilitate the opening, are pinched with his fingers to get the holding body 8 extended to the both sides thereof (in the front and back directions in FIG. 8) so that the articles of battery 1 can be taken out. After the cutting along the cutting portions 6, 20 and 21, the holding body 8 in the battery package can be used as a container for storage of the battery 1, as shown in FIG. 8.

Figure 7:
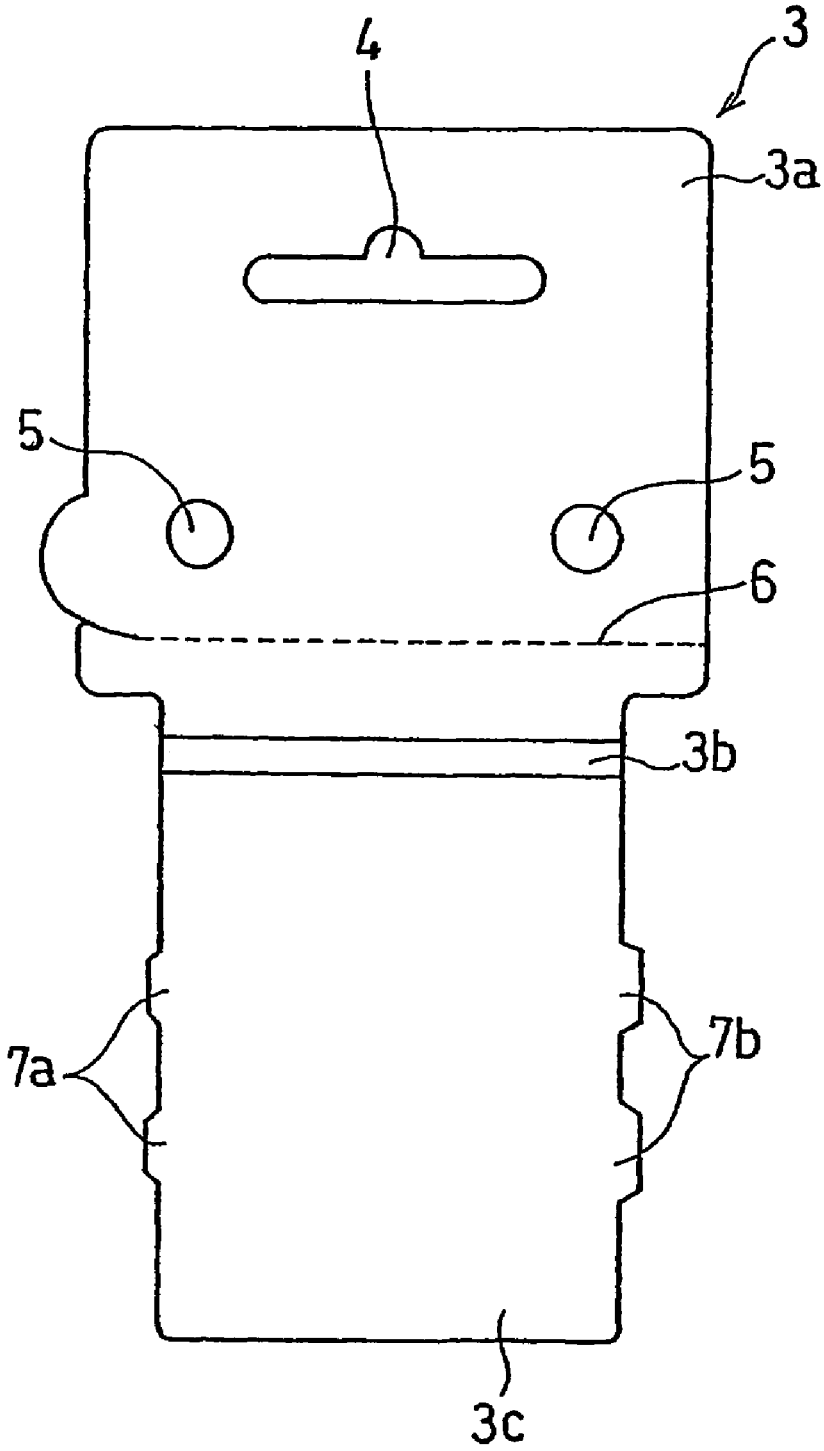
FIG. 7 is a front view of the hanging member in the same battery package.

As shown in FIG. 3 and FIG. 7, in order that the hanging member 3 can remain fixed to the holding body 8, it is preferable to form projections 7*a* and 7*b* on the under part 3*c* of the hanging member 3, the projections 7*a* being caught between the plural depressions 12*a* provided on one side of the holding body and projections 7*b* being caught between the plural depressions 12*b* provided on the other side of the holding body.

Figure 6:
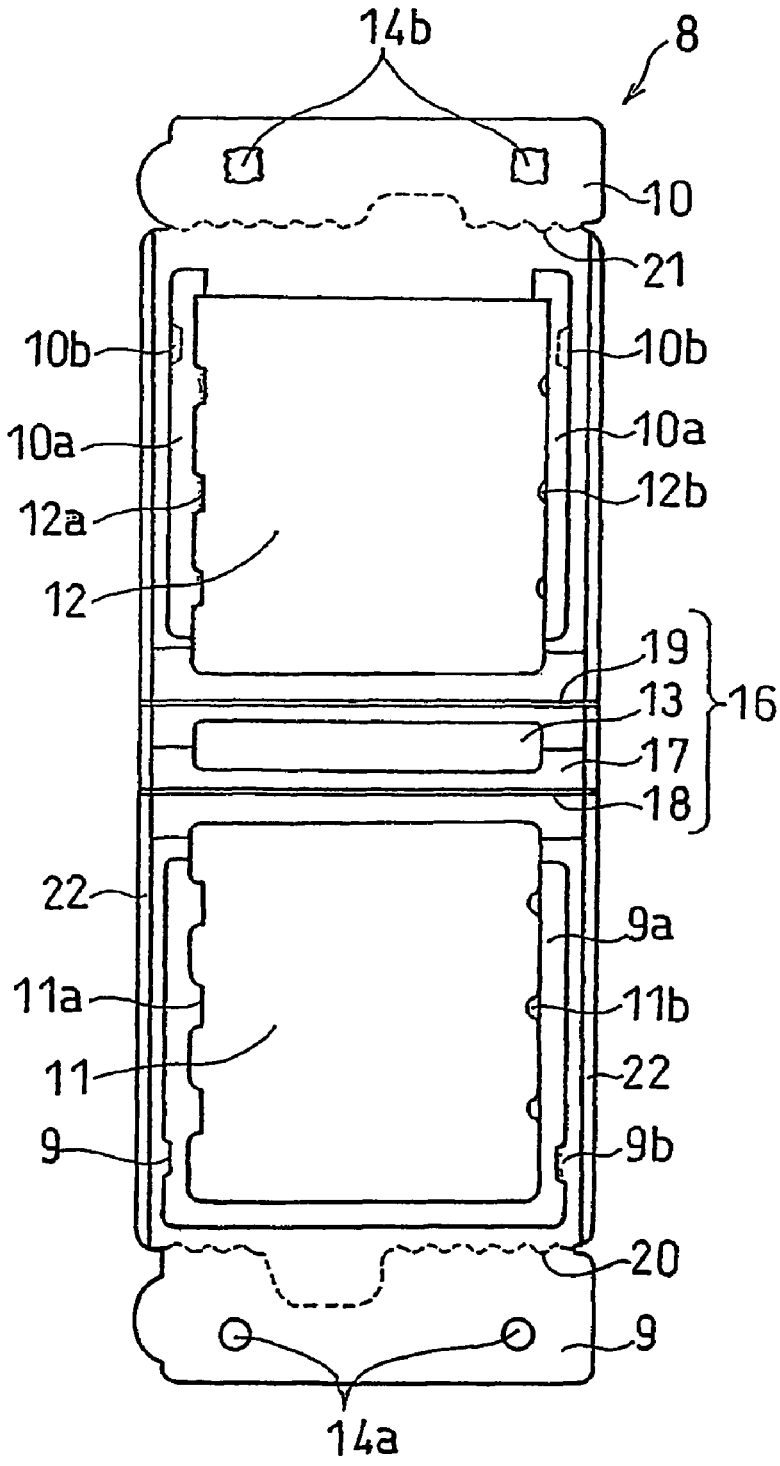
FIG. 6 is a front view of the holding body in the same battery package.

Moreover, as shown in FIG. 3 and FIG. 6, in order to stably house the articles of battery 1 in the first recess 11 and the second recess 12 of the holding body 8, it is preferable to form projections 11*a*, 11*b*, 12*a* and 12*b*, which are accommodated to the battery shape, respectively on both sides of the first recess 11 and both sides of the second recess 12. Further, the holding body 8 may be provided on the side face rim thereof with a folding-back portion 22. This enables improvement in intensity of the battery package.

The first brim portion 9 has a depression 9*a* while the second brim portion 10 has a projection 10*a* to be latched into the depression 9*a*. Further, a pair of projections 10*a* each has a groove portion 10*b* on the outside thereof; a pair of depressions 9*a* each has a projection 9*b* on the right or left end thereof to fit into the groove portion 10*b*. When the holding body 8 is folded back, the holding body 8 as a container can be prevented from transforming by certain fitting of the projections 10*a* into the depressions 9*a* and the projections 9*b* into the groove portions 10*b*. Furthermore, even after the battery package has been opened, the holding body 8 can be opened and closed, and also used as a container for storage, which has stable storage properties.

As shown in FIGS. 2, 3 and 6, a bending portion 16 has a bottom portion 17 that connects the first recess 11 and the second recess 12. Further, the bending portion 16 has a pair of line portions 18 and 19 for folding capable of bending to fold back the holding body 8 so that the recess 11 and the recess 12 are faced to each other, the pair of line portions 18 and 19 for folding being provided on the boundary between the bottom portion 17 and the recesses 11/12. The bottom portion 17 has a third recess 13 constituting the bottom of the housing portion formed by the recesses 11 and 12. This allows exhibition of the battery package in a vertically placed state, with the bottom portion 17 used as the bottom of the battery package when placed.

As the aforementioned hanging member 3 and the holding body 8, a resin of polyethylene terephthalate or the like can be used. The use of the same material for the hanging member 3 and the holding body 8 can facilitate treatments thereof, such as correction thereof having become disused. Moreover, it is preferable that at least the holding body 8 is transparent to get the housed battery articles visible, whereas the hanging portion 3 may be made of another material, such as paper.

Embodiment 2

A battery package containing eight cylindrical battery articles is explained below by reference to FIGS. 9 to 11.

Figure 9:
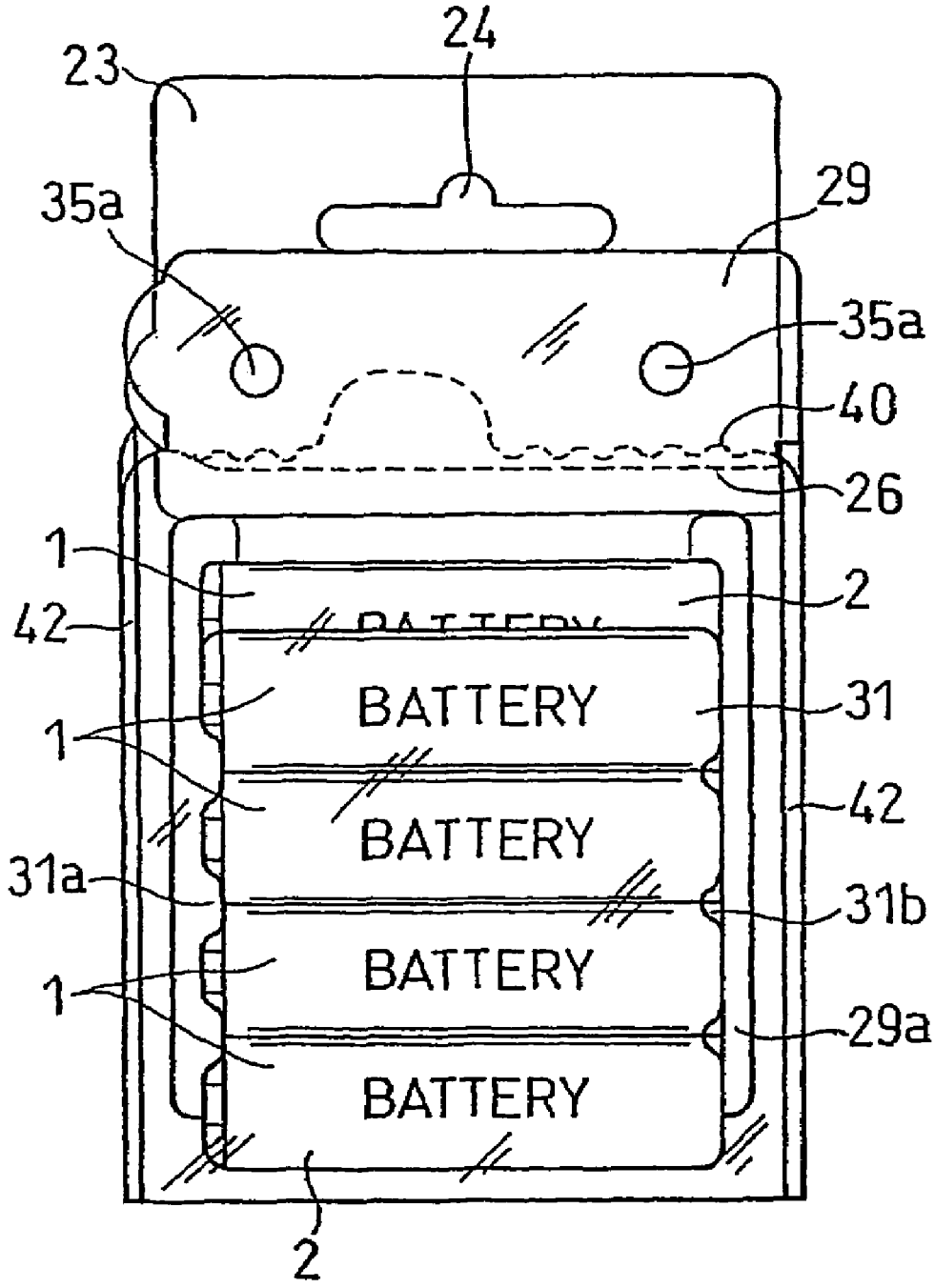
FIG. 9 is a front view of a battery package in Embodiment 2.
Figure 10:
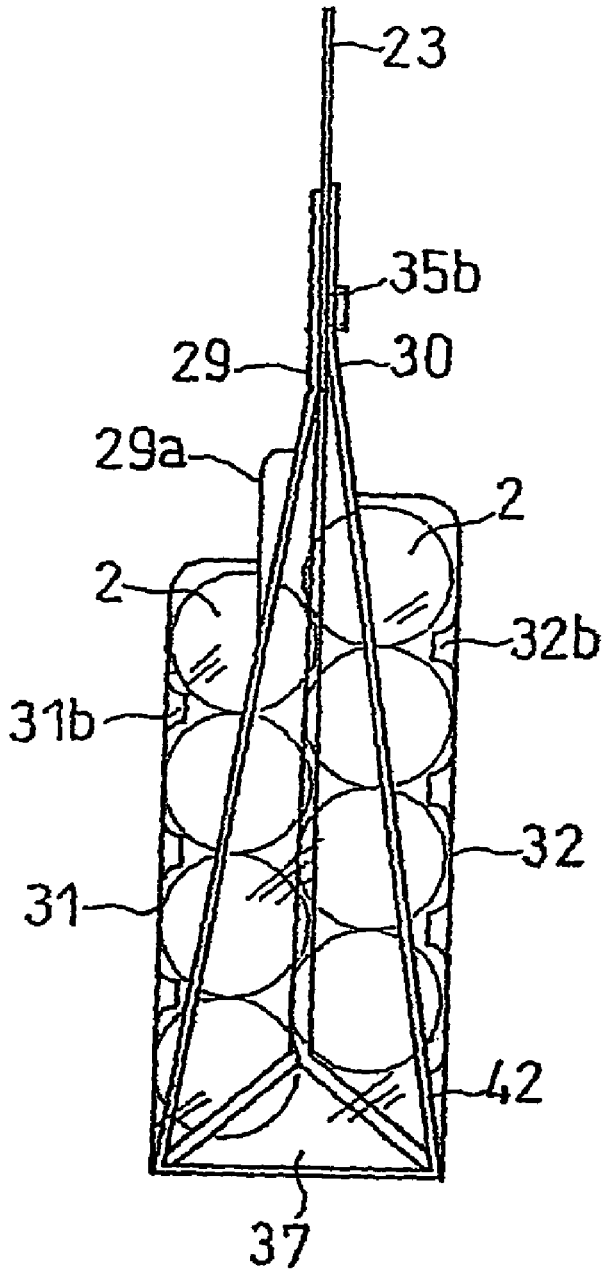
FIG. 10 is a side view of the same battery package.
Figure 11:
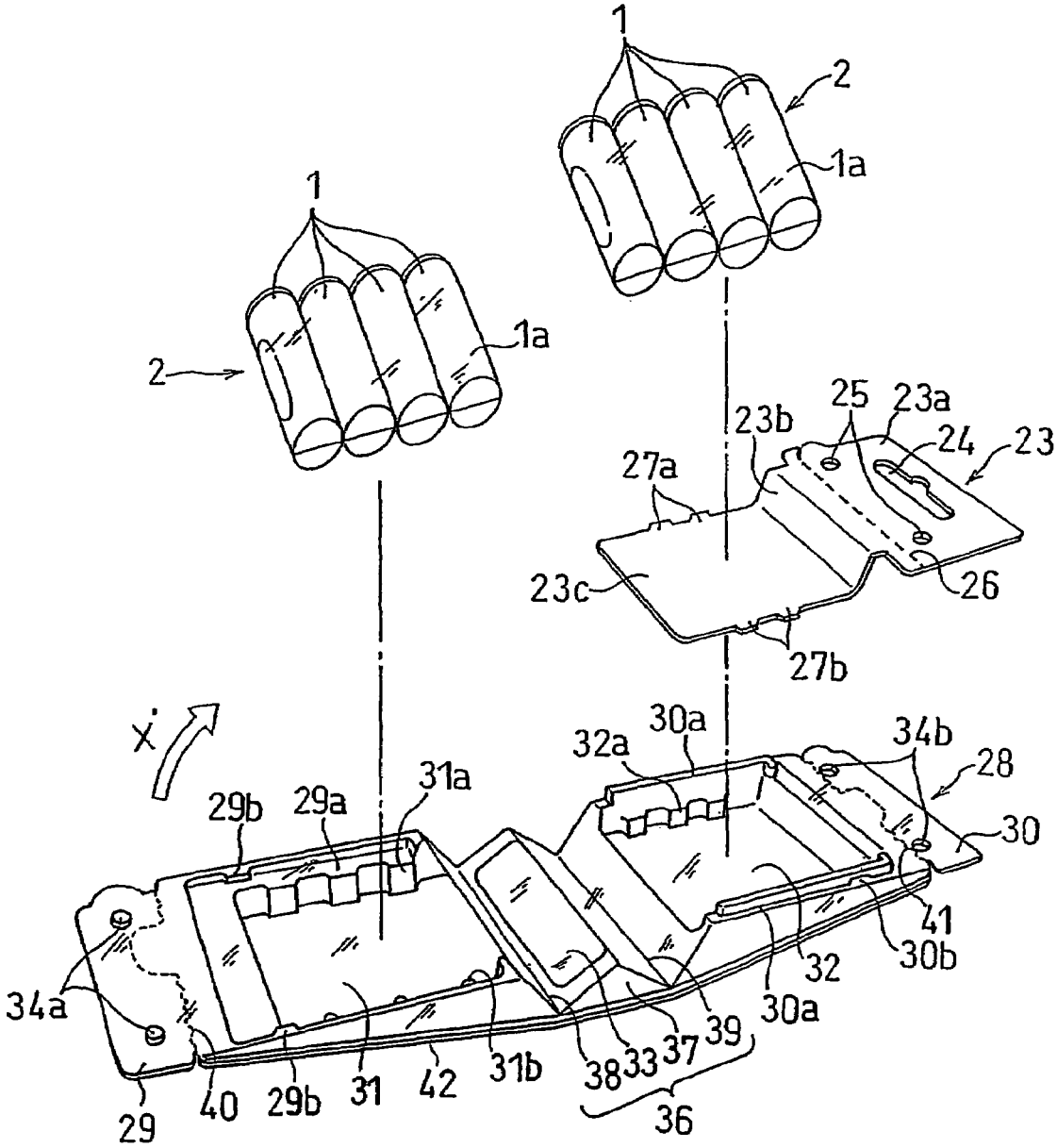
FIG. 11 is an exploded perspective view of the same battery package.
Figure 12:
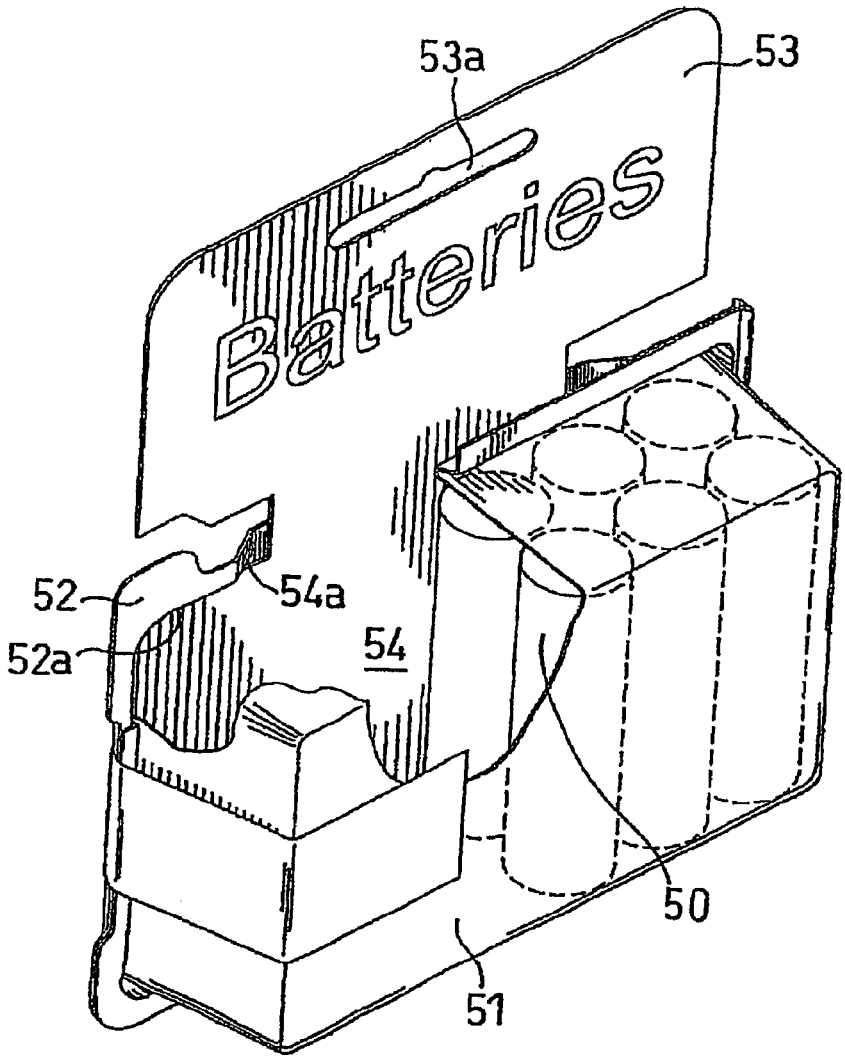
PRIOR ART FIG. 12
FIG. 12 is a perspective view of a conventional battery package.

FIG. 9 is a front view of a battery package of the present invention that houses two unit packs 2, each comprising a wrapping portion 1*a* obtained by vertically laying down and shrink-packing four articles of cylindrical battery 1 (cf. FIG. 11); FIG. 10 is a side view of the same battery package; and FIG. 11 is an exploded perspective view of the same battery.

As shown in FIGS. 9 to 11, in a battery package of the present embodiment, a housing portion is formed on each side of a hanging member 23 by a first recess 31 or a second recess 32 to house a unit pack 2, in order that the weight of the unit packs 2 is loaded on both sides of the hanging member 23 in a balanced manner when the battery package is hung. Except for this, the battery package of the present embodiment is constituted in the same manner as in Embodiment 1. As thus indicated, even in the case of housing a number of battery articles, the battery package can be kept well balanced when hung.

As shown in FIG. 10, two unit packs 2 are housed in the holding body 28 in a misaligned manner so that the each article of battery 1 is held at a different height. This makes it possible to stably house the battery articles and get the space necessary for the housing smaller.

INDUSTRIAL APPLICABILITY

As thus described, according to the present invention, there can be provided a commodity package that is capable of maintaining favorable balance and also has sufficient intensity when it is hung.

The invention claimed is:

1. A commodity package, comprising a hanging member that has a hole for hanging, and a holding body for holding an article characterized in that said holding body has: a housing portion including a first recess and a second recess for housing said article; a first brim portion and a second brim portion for closing said first recess and said second recess to form said housing portion; and a bending portion that connects said first recess and said second recess, and bends to fold back said holding body so that said first recess and said second recess are faced to each other, said hanging member is interposed between said brim portions and said recesses, said holding body has a first cutting portion for separating said first recess and the upper part of said first brim portion from each other, and a second cutting portion for separating said second recess and the upper part of said second brim portion from each other, said hanging member has a third cutting portion for separating the upper part and the lower part thereof from each other, and wherein, said first, second and third cutting portions are each provided at different heights relative to a top edge of said hanging portion, such that said first, second and third cutting portions do not overlap with one another.

2. The commodity package in accordance with claim 1, wherein said housing portion is formed on each side of the plane of said hanging member, said plane having said hole for hanging.

3. The commodity package in accordance with claim 1, wherein part of said first cutting portion and part of said second cutting portion are shaped such that said holding body forms a knob portion for opening and closing said commodity package after said cutting portions have been cut.

4. The commodity package in accordance with claim 1, wherein, in a portion where said hanging member is interposed between said first brim portion and said second brim portion, one of said brim portions has a projection for crushing and the other of said brim portions has a depression into which said projection is to fit, and said hanging member has a hole that accommodates said projection, such that said projection for crushing is put thorough said hole, said projection for pushing in the state of fitting into said depression is crushed, and a latch portion, formed as said projection for crushing transforms by extending outward, is latched into said hole and said depression to fix said hanging member to said holding body.

5. The commodity package in accordance with claim 1, wherein one of said first brim portion and said second brim portion has a depression and the other of said brim portions has a projection to fit into said depression.

6. The commodity package in accordance with claim 1, wherein said holding body comprises side rims, and a folding-back portion on each of said side rims.

7. The commodity package in accordance with claim 1, wherein each of said first recess and said second recess has a depression on the right or the left side face of the inside thereof, and said hanging member has projections to fit into said depressions.

8. The commodity package in accordance with claim 1, wherein said bending portion comprises: a bottom portion that connects said first recess and said second recess; and a pair of line portions for folding capable of bending to fold back said holding body so that said recesses are faced to each other, said pair of line portions for folding being provided on boundary between said bottom portion and said recesses.

9. The commodity package in accordance with claim 8, wherein said holding body in which said housing portion is formed with said bottom portion can be placed vertically.

* * * * *